US007697862B2

(12) United States Patent
Kim et al.

(10) Patent No.: US 7,697,862 B2
(45) **Date of Patent: *Apr. 13, 2010**

(54) HIGH VOLTAGE SWITCH DEVICE AND MULTI-PASS IMAGE FORMING APPARATUS HAVING THE SAME

(75) Inventors: Sung-dae Kim, Suwon-si (KR); Cheol-young Han, Yongin-si (KR); Young-min Yoon, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1110 days.

This patent is subject to a terminal disclaimer.

(21) Appl. No.: 11/341,435

(22) Filed: Jan. 30, 2006

(65) Prior Publication Data

US 2006/0257160 A1 Nov. 16, 2006

(30) Foreign Application Priority Data

May 13, 2005 (KR) ..... 10-2005-0040144

(51) Int. Cl.
*G03G 15/00* (2006.01)

(52) U.S. Cl. ..... 399/90; 399/223; 399/228

(58) Field of Classification Search ..... 399/80, 399/90, 223, 228, 107, 119, 297, 302, 308
See application file for complete search history.

(56) References Cited

U.S. PATENT DOCUMENTS

| | | | | |
|---|---|---|---|---|
| 3,981,267 | A | 9/1976 | Gardiner | |
| 5,099,278 | A * | 3/1992 | Sato | 399/75 |
| 5,521,693 | A * | 5/1996 | Kojima et al. | 399/228 |
| 5,828,934 | A * | 10/1998 | Tamura et al. | 399/228 |
| 6,842,598 | B2 * | 1/2005 | Kibune et al. | 399/223 |
| 7,376,373 | B2 * | 5/2008 | Kim et al. | 399/228 |
| 2003/0138269 | A1 | 7/2003 | Hiroki | |

FOREIGN PATENT DOCUMENTS

| | | |
|---|---|---|
| JP | 06-328726 | 11/1994 |
| JP | 2000-242059 | 9/2000 |
| JP | 2002-099129 | 4/2002 |
| JP | 2003-208024 | 7/2003 |
| JP | 2003-291385 | 10/2003 |

* cited by examiner

*Primary Examiner*—David P Porta
*Assistant Examiner*—Benjamin Schmitt
(74) *Attorney, Agent, or Firm*—Roylance, Abrams, Berdo & Goodman, L.L.P.

(57) ABSTRACT

A high voltage switch device includes a plurality of switches installed between a high voltage power unit and a plurality of developing units. A plurality of cams are disposed on a cam shaft corresponding to the respective switches. The switches are selectively turned "on" and "off" as the cam shaft rotates.

19 Claims, 9 Drawing Sheets

HIGH VOLTAGE SWITCH DEVICE AND MULTI-PASS IMAGE FORMING APPARATUS HAVING THE SAME

CROSS REFERENCE TO RELATED APPLICATION

This application claims the benefit under 35 U.S.C. § 119 (a) of Korean Patent Application No. 10-2005-0040144, filed on May 13, 2005 in the Korean Intellectual Property Office, the entire disclosure of which is hereby incorporated by reference.

BACKGROUND OF THE INVENTION

1. Field of the Invention

The present invention relates to a high voltage switch device, and a multi-pass image forming apparatus having the same. More particularly, the present invention relates to a high voltage switch device that selectively supplies high current to a plurality of devaluing units, and a multi-pass image forming apparatus having the high voltage switch device.

2. Description of the Related Art

Generally, an electrophotographic color image forming apparatus forms a color mage by forming an electrostatic latent image on a photosensitive medium charged with a uniform electric potential by emitting a beam onto the photosensitive medium. The electrostatic image is developed with a toner of a predetermined color, and transferred and fixed onto print paper. Toner colors generally used in the color image forming apparatus are yellow (Y), magenta (M), cyan (C), and black (K). Therefore, to adhere the four toner colors on the electrostatic latent image, four developing units are required. A high voltage (that is, over hundreds to thousands of volts)for developing bias for adhering the toners onto the photosensitive medium and for supply bias for supplying the toner to the developing rollers are supplied to the developing units.

Methods of forming a color image include a single path method in which four exposure units and four photosensitive mediums are used, and a multi-pass method in which a single exposure unit and a single photosensitive medium are used. A color image forming apparatus adopting the single pass method takes approximately the same time for color printing and black and white printing, and, thus, is usually used in a high-speed color image forming apparatus. However, because it has four exposure units and four photosensitive mediums, the price of the color image forming apparatus adopting the single pass method is high. Thus, a color image forming apparatus operating in a relatively low speed includes a single photosensitive medium and a single exposure unit and adopts the multi-pass method in which exposing, developing, and image transferring are repeatedly performed for each of the colors to form a color image on an intermediary medium and to transfer the color image onto print paper.

In an image forming apparatus using the multi-pass method, the four developing units operate sequentially. Thus, a device for sequentially transmitting the rotation force of a driving motor to the four developing units is required. A multi-pass image forming apparatus is desired, such as for inkjet printers for small office and home office (SOHO) use, as well as for color image forming apparatuses for home use. Thus, miniaturization and low cost of the multi-pass image forming apparatus are important. A conventional high voltage switch device selectively connects four switches using four axial type solenoids. The conventional high voltage switch device is expensive and large. Additionally, when the solenoid is turned "on," heat is generated, thereby reducing durability.

Accordingly, a need exists for an improved high voltage switch device that reliably controls high-voltage current transmitted to a developing unit of a multi-pass image forming apparatus.

SUMMARY OF THE INVENTION

The exemplary embodiments of the present invention provide a high voltage switch device capable of reliably controlling a high-voltage current transmitted to a developing unit and enabling miniaturization and cost reductions, and a multi-pass image forming apparatus having the high voltage switch device According to an aspect of exemplary embodiments of the present invention, a high voltage switch device of an image forming apparatus includes a plurality of switches installed between a high voltage power unit and a plurality of developing units; a cam shaft; and a plurality of cams disposed on the cam shaft to correspond to the respective switches, and selectively turning "on" and "off" the switches as the cam shaft rotates.

The cam shaft may rotate by a driving source that drives the developing units. The high voltage switch device may further include a regulating element that regulates a driving force transmitted from the driving source to the cam shaft. The regulating element may include: a spring clutch that is disposed between the driving source and the cam shaft, and includes a plurality of coupling portions corresponding to the phases of the cams; and an actuator selectively coupled to the coupling portions to selectively operate the spring clutch.

The high voltage switch device may further include a home position indicating element formed on the cam shaft; a sensor for sensing the home position indicating element; and a home position coupling portion formed on the spring clutch at the same phase as the home position indicating element. The phase of the home position coupling portion may not overlap with the phases of the coupling portions.

The high voltage switch device may further include a stepping motor that rotates the cam shaft; a home position indicating element formed on the cam shaft; and a sensor for sensing the home position indicating element.

The developing units and the cams may be divided into a plurality of groups, and the cams included in the same group may have the same phases.

According to another aspect of exemplary embodiments of the present invention, a multi-pass image forming apparatus sequentially develops a single-color toner image on a photosensitive medium by sequentially operating a plurality of developing units facing the photosensitive medium and prints a color image by transferring the single-color toner images on top of each other on an intermediary transfer medium. The multi-pass image forming apparatus includes a plurality of switches disposed between a high voltage power unit and the developing units; a cam shaft; and a plurality of cams that are disposed on the cam shaft to correspond to the respective switches, and selectively operating the switches as the cam shaft rotates.

The cam shaft may rotate by a driving source that drives the developing units, and the multi-pass image forming apparatus may further include a regulating element that regulates a driving force transmitted from the driving source to the cam shaft.

The multi-pass image forming apparatus may further include two photosensitive media; and four developing units accommodating yellow, magenta, cyan, and black color toners. The four developing units are divided into two groups and the developing units of each group respectively face the two photosensitive media, and the cams are divided into two groups each corresponding to the two groups of the developing units and the cams included in the same group have the same phases.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, the same drawing reference numerals will be understood to refer to the same elements, features, and structures.

DETAILED DESCRIPTION OF EXEMPLARY EMBODIMENTS

The present invention will now be described more fully with reference to the accompanying drawings, in which exemplary embodiments of the invention are shown.

Figure 1:
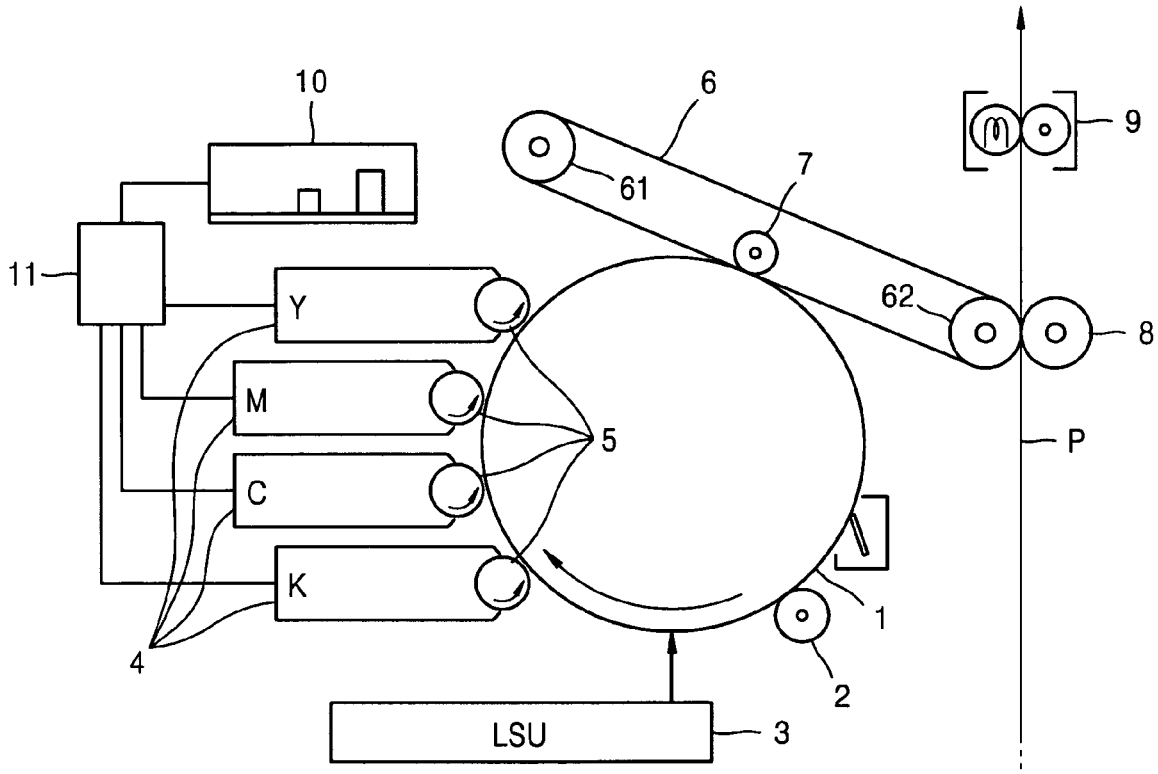
FIG. 1 is a schematic diagram of an electrophotographic image forming apparatus according to an exemplary embodiment of the present invention.

FIG. 1 is a schematic diagram of an electrophotographic image forming apparatus according to an exemplary embodiment of the present invention. Referring to FIG. 1, the electrophotographic image forming apparatus includes a photosensitive drum 1, a charging roller 2, an exposure unit 3, four developing units 4, an intermediary transfer belt 6, a first transfer roller 7, a second transfer roller 8, and a fixing unit 9.

Figure 8:
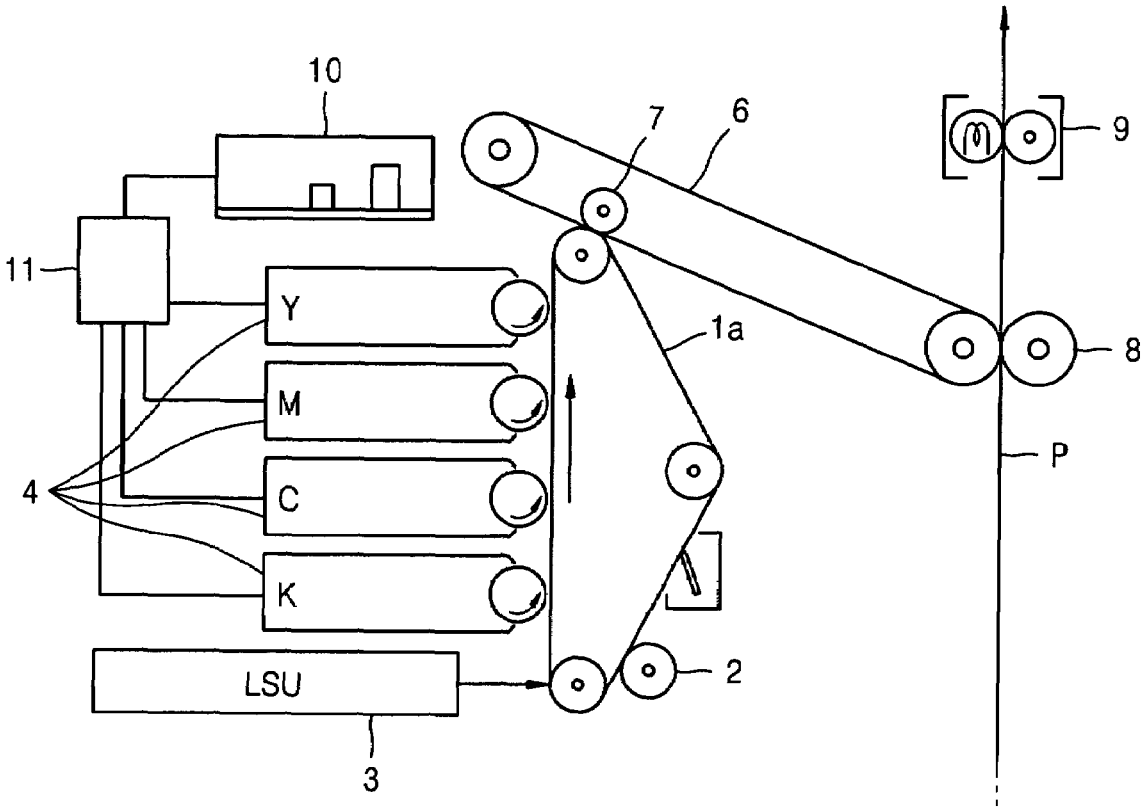
FIG. 8 is a schematic diagram of an electrophotographic image forming apparatus according to another exemplary embodiment of the present invention.

An optical conductive layer is formed on the outer circumference of the cylindrical photosensitive drum 1, which is preferably made of metal. Instead of the photosensitive drum 1, a photosensitive belt 1*a* may be used, as illustrated in FIG. 8. The charging roller 2 is an example of a charging unit that charges the photosensitive drum 1 with a uniform potential. The charging roller 2 charges the outer circumference of the photosensitive drum 1 with a uniform potential by supplying electric charges to the outer circumference of the photosensitive drum 1 while rotating in contact or not in contact with the outer circumference of the photosensitive drum 1. A corona discharger (not shown) may be used instead of the charging roller 2. The exposure unit 3 emits light corresponding to image information onto the photosensitive drum 1 charged with a uniform potential to form an electrostatic latent image. A laser scanning unit (LSU), which usually includes a laser diode as a light source, is used as the exposure unit 3.

The electrophotographic image forming apparatus of an exemplary embodiment of the present embodiment may use cyan (C), magenta (M), yellow (Y), and black (K) toners to print a color image. Hereinafter, when there is a need to differentiate components according to their colors, Y, M, C, and K will be added at the end of the reference number of each component.

The four developing units 4 respectively accommodate cyan, magenta, yellow, and black toners. Each of the developing units 4 includes a developing roller 5. The developing units 4 perform non-contact developing by being separated from the developing roller 5 by as much as a developing gap. The developing gap may be tens to hundreds of microns. Each of the developing units 4 may further include a supplying roller (not shown), an agitator (not shown), and so forth, in addition to the developing roller 5.

The intermediary transfer belt 6 is supported by support rollers 61 and 62 and travels at approximately the same speed as the circumference of the photosensitive drum 1. The length of the intermediary transfer belt 6 is equal to or greater than the length of the maximum sized print paper P used in the electrophotographic image forming apparatus. The first transfer roller 7 faces the photosensitive drum 1, and a first transfer bias is supplied to the first transfer roller 7 so that a toner image developed on the photosensitive drum 1 is transferred to the intermediary transfer belt 6. The second transfer roller 8 is separated from the intermediary transfer belt 6 while the toner image is transferred from the photosensitive drum 1 to the intermediary transfer belt 6. When the toner image is completely transferred to the intermediary transfer belt 6, the second transfer roller 8 contacts the intermediary transfer belt 6 with a predetermined pressure. A second transfer bias is supplied to the second transfer roller 8 to transfer the toner image onto the print paper P.

A process of forming a color image using the electrophotographic image forming apparatus of an exemplary embodiment of the present embodiment will be briefly described. The exposure unit 3 emits light corresponding to, for example, yellow color image information onto the photosensitive drum 1, which is charged with a uniform potential by the charging roller 2. An electrostatic latent image corresponding to a yellow color image is formed on the photosensitive drum 1. A developing bias is supplied to the developing roller 5 of the yellow color developing unit 4Y. Then, the yellow toner adheres to the electrostatic latent image, thereby forming a yellow color toner image on the photosensitive drum 1. The yellow color toner image is transferred onto the intermediary transfer belt 6 due to the first transfer bias supplied to the first transfer roller 7. After transferring of the yellow color toner image of a page is completed, the exposure unit 3 emits light corresponding to, for example, magenta color image information onto the photosensitive drum 1, which is recharged with a uniform potential by the charging roller 2. Thus, an electrostatic latent image corresponding to the magenta color image is formed on the photosensitive drum 1. The magenta developing unit 4M develops the electrostatic latent image by supplying a magenta toner thereto. The magenta color toner image formed on the photosensitive drum 1 is transferred to the intermediary transfer belt 6 to overlap the yellow toner image. The same process is also performed for the cyan and black colors, and a color toner image is produced by overlapping the yellow, magenta, cyan, and black color toner images. The color toner image is transferred onto the print paper P passing between the intermediary transfer belt 6 and the second transfer belt 8 due to the second transfer bias. The fixing unit 9 fixes the color toner image onto the print paper P through heat and pressure. Through the process described above, an image may be formed by a multi-pass color image forming apparatus including a single photosensitive drum (photosensitive medium) 1, an exposure unit 3, and four developing units 4.

As described above, the developing bias is supplied to the developing roller 5 to adhere the toner onto the photosensitive drum 1, and a supply bias is supplied to a supply roller (not shown) to supply the toner to the developing roller 5. The developing bias and the supply bias may be DC or a combination of AC and DC. The voltage of the developing bias and the supply bias is a high voltage of over hundreds to thousands of volts. A high voltage power unit 10 provides a high voltage bias. A plurality of developing units 4 are sequentially operated in the multi-pass color image forming apparatus. For example, a developing bias may be supplied only to the developing roller 5Y of the selected developing unit 4Y and not to the rest of the developing units 4M, 4C, and 4K. Similarly to the developing bias, a supply bias may be supplied only to the supply roller of the selected developing unit 4Y and not to the rest of the developing units 4M, 4C, and 4K. To this end, the electrophotographic image forming apparatus includes a high-voltage switch device 11 to selectively transmit a high voltage bias to the developing units 4.

Figure 2:
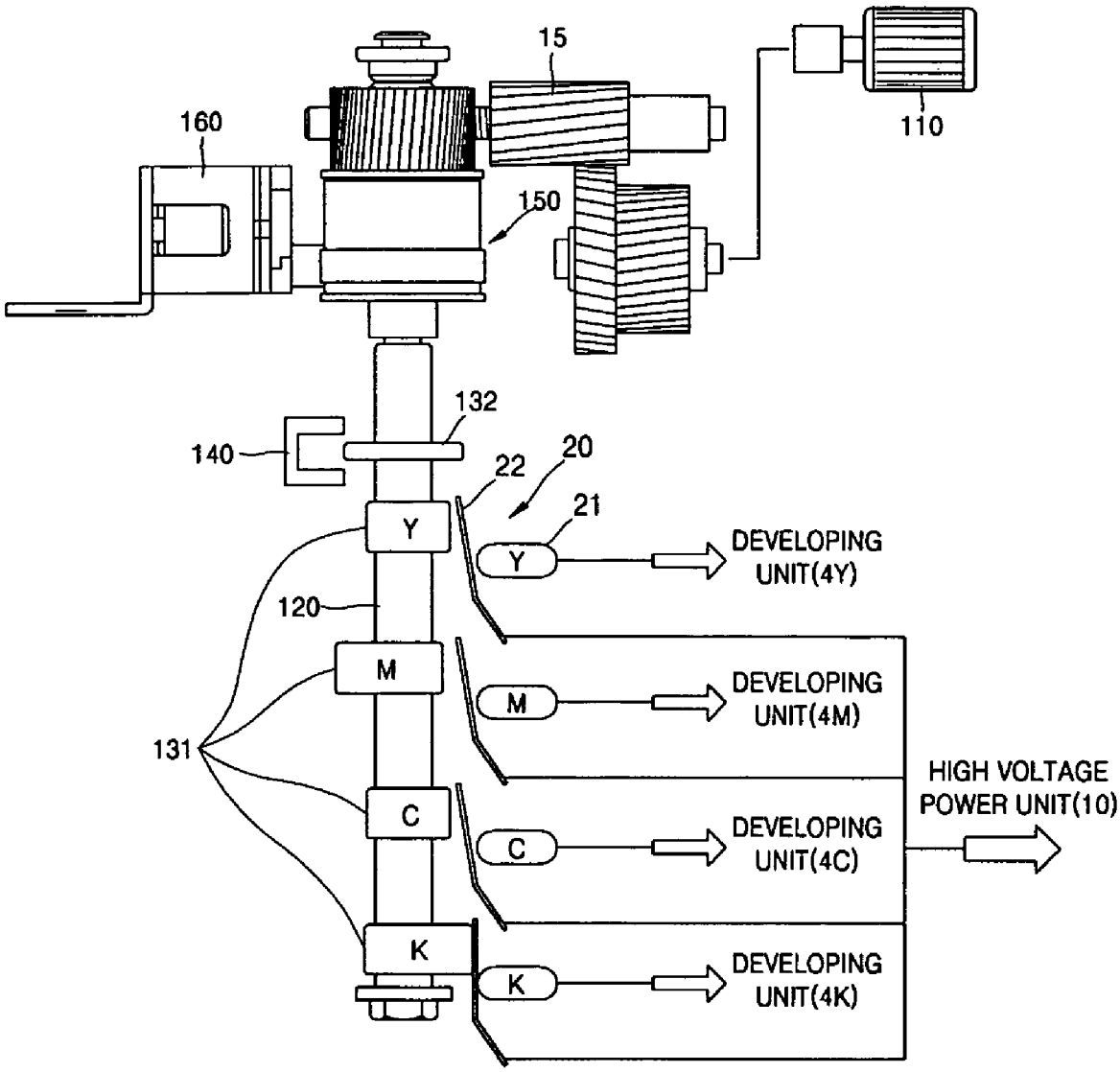
FIG. 2 is a diagram of a high voltage switch device according to an exemplary embodiment of the present invention.
Figure 3:
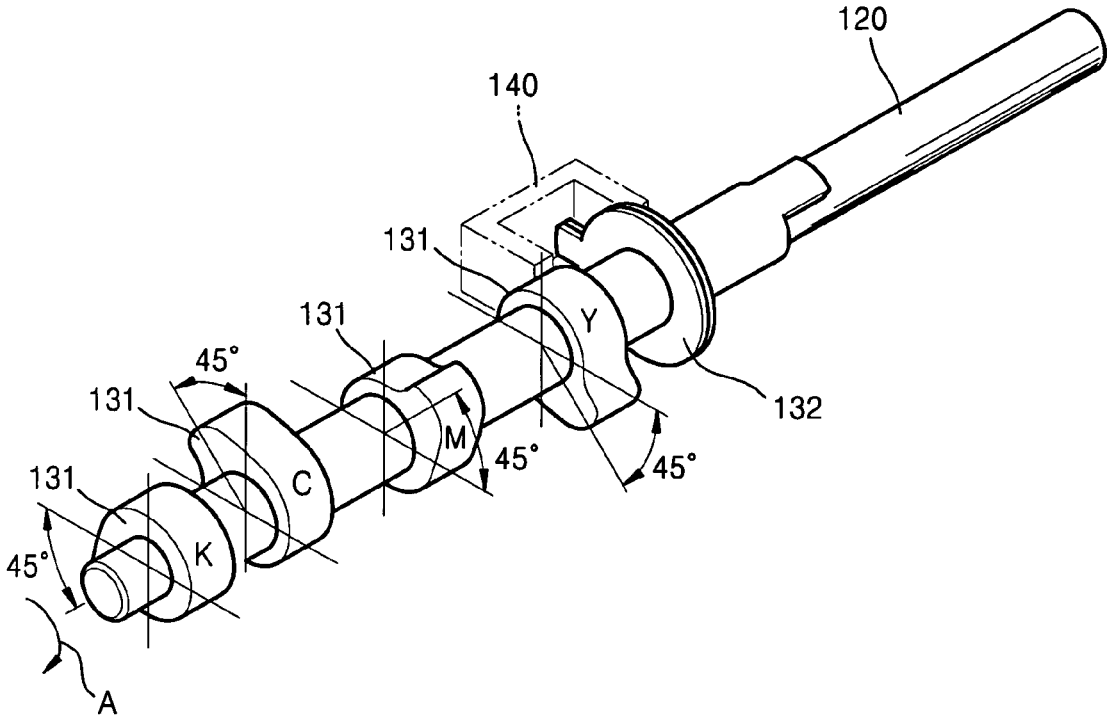
FIG. 3 is a perspective view of a cam shaft of FIG. 2.

FIG. 2 is a diagram of the high voltage switch device 11 according to an exemplary embodiment of the present invention. Referring to FIG. 2, four switches 20 are installed between the high voltage power unit 10 and the four developing units 4. For example, each of the switches 20 includes two contact points 21 and 22. A high voltage bias is supplied to the respective developing unit 4 when the two contact points 21 and 22 come in contact, and a high voltage bias is cut off when the two contact points 21 and 22 are separated from each other. The contact point 22 is made of a conductive material having, for example, an elastic force acting in a direction separating the contact point 22 from the contact point 21. The four switches 20 are not limited to the ones illustrated in FIG. 2, and may be constructed in many different ways. The high voltage switch device 11 includes a cam shaft 120 and four cams 131 corresponding to the four switches 20 to selectively operate the switches 20. In an exemplary embodiment of the present invention, the four cams 131 and the cam shaft 120 are formed in a single body by injection molded plastics. The four cams 131 are disposed at different phases. For example, the four cams 131 are sequentially separated from each other by approximately 90 degrees, as illustrated in FIG. 3. When the cam shaft 120 rotates, the four cams 131 sequentially push the contact points 22, thereby contacting the contact points 21. Thus, the four switches 20 are successively turned "on" and "off."

Figure 4:
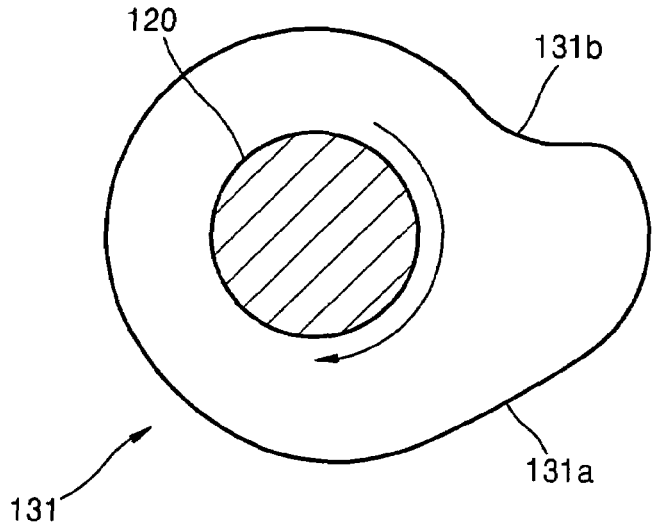
FIG. 4 is an elevational view of a cam of FIG. 2.

The cam 131 has a first locus 131 a that smoothly connects the contact point 22 to the contact point 21 and a second locus 131*b* that allows the contact point 22 to quickly separate from the contact point 21, as illustrated in FIG. 4. The first locus 131*a* for contacting the contact point 22 to the contact point 21 may have a large radius of curvature. The radius of curvature of the second locus 131*b* may be small. Two pairs of switches (for example, 20Y and 20M, 20M and 20C, 20C and 20K, or 20K and 20Y) are not simultaneously turned "on." As the cam 131 rotates, the contact point 22 is pushed by the first locus 131 a and comes in contact with the contact point 21, and when the contact point 22 contacts the second locus 131*b*, the contact point 22 is separated from the contact point 21 by its own elastic force.

In the electrophotographic image forming apparatus having the structure as described above, a high voltage bias is supplied to the developing unit 4Y by, for example, rotating the cam shaft 120 and turning "on" the switch 20Y using the cam 131Y. When the developing of the yellow color image is completed, the cam shaft 120 rotates approximately 90 degrees in the direction A illustrated in FIG. 3. Thus, the switch 20Y is turned "off," and the cam 131M turns "on" the switch 20M, thereby supplying the high voltage bias to the developing unit 4M. Through this process, the high voltage bias may be sequentially supplied to the developing units 4.

According to the above-described structure, the high voltage switch device may be configured having a moderate price compared to a conventional high voltage switch device including four solenoids. Since the high voltage switch device of an exemplary embodiment of the present invention includes a very simple mechanical structure, it may also be very compact. Heat is not produced, and thus there is less of a possibility of a malfunction, which results in a reliable high voltage switch device. Additionally, the solenoids included in the conventional high voltage switch device cause noise during operation. However, the high voltage switch device of an exemplary embodiment of the present invention uses cams, and thus operational noise is hardly produced. A compact, reliable multi-pass image forming apparatus that is moderately priced is configured by including the high voltage switch device of an exemplary embodiment of the present invention described above.

The cam shaft 120 is rotated by a driving motor 110, which drives at least one of the other components of the electrophotographic image forming apparatus (for example, the photosensitive drum 1, the charging roller 2, the intermediary belt 6, the first and second transfer rollers 7 and 8, and the fixing unit 9). The cam shaft 120 rotates only when performing a high voltage switch operation. To do this, the electrophotographic image forming apparatus includes a regulating element which regulates the rotational force of the driving motor 110 transmitted to the cam shaft 120.

Figure 5:
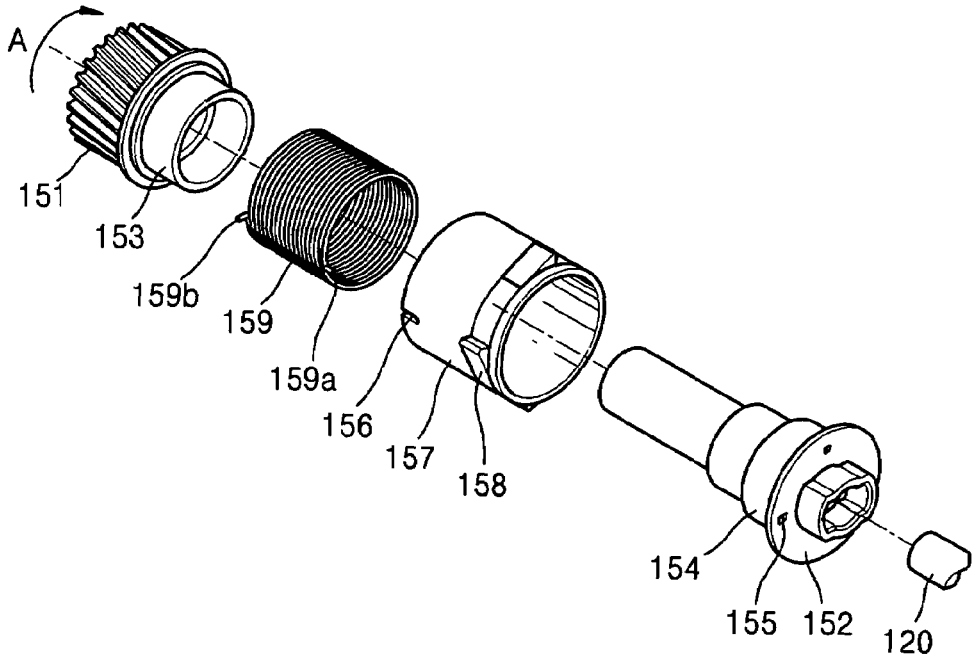
FIG. 5 is an exploded perspective view of a spring clutch of FIG. 2.
Figure 6:
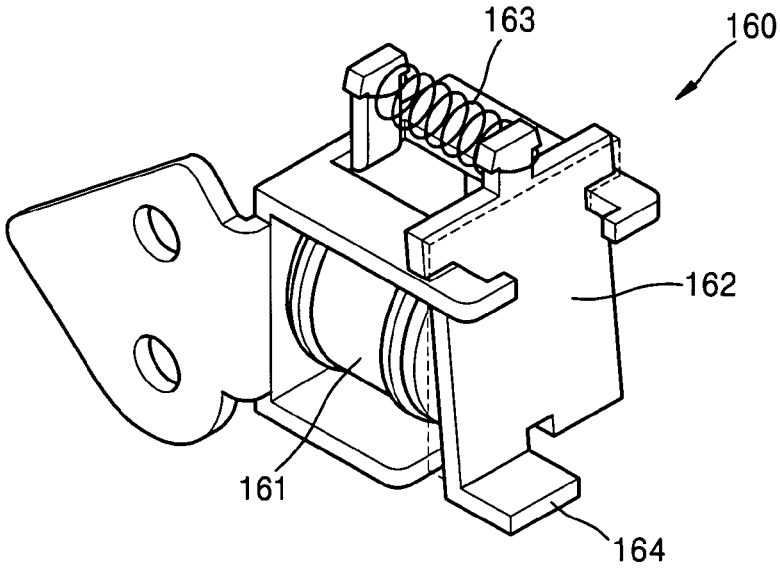
FIG. 6 is a perspective view of a solenoid of FIG. 2.

For example, the regulating element may include a spring clutch 150 coupled to the cam shaft 120, and a solenoid (actuator) 160 for selectively operating the spring clutch 150, as illustrated in FIGS. 2, 5, and 6. The spring clutch 150 includes a clutch gear 151, a clutch spring 159, a clutch hub 157, and a bushing 152. The bushing 152 is fixed to one end of the cam shaft 120 and the clutch gear 151 is rotatably coupled to the bushing 152. The bushing 152 may be integrated with the cam shaft 120. The clutch spring 159 surrounds both cylindrical portions 153 and 154 of the clutch gear 151 and the bushing 152. The clutch hub 157 encompasses the clutch spring 159. Four coupling portions 158 are formed on the clutch hub 157 corresponding to the respective four cams 131. The coupling portions 158 in an exemplary embodiment of the present invention are separated from one another by approximately 90 degrees. A first end 159*a* and a second end 159*b* of the clutch spring 159 are respectively inserted into inserting holes 155 and 156 formed on the bushing 152 and the clutch hub 157. The clutch gear 151 is connected to, for example, a gear 15 that is rotated by the driving motor 110. The driving motor 110 rotates the clutch gear 151 in the direction A, indicated by an arrow. The clutch spring 159 strongly tightens around the cylindrical portions 153 and 154 of the clutch gear 151 and the bushing 152 as the clutch spring 159 is twisted in a direction in which its inside diameter decreases. Therefore, when the clutch gear 151 rotates in the direction A, the clutch spring 159 and the bushing 152 rotate, as well as the cam shaft 120. The clutch hub 157 also rotates because the second end 159*b* of the clutch spring 159 is inserted into the inserting hole 156 of the clutch hub 157.

FIG. 6 is a perspective view of the solenoid 160. The solenoid 160 includes a coil unit 161, a moving side 162, and a spring 163. A stopper 164 is formed on one end of the moving side 162. When current is supplied to the coil unit 161, the moving side 162 adheres to the coil unit 161 as illustrated by the dashed lines. When the current is blocked, the moving side 162 returns to its original location due to the elastic force of the spring 163.

Figure 7:
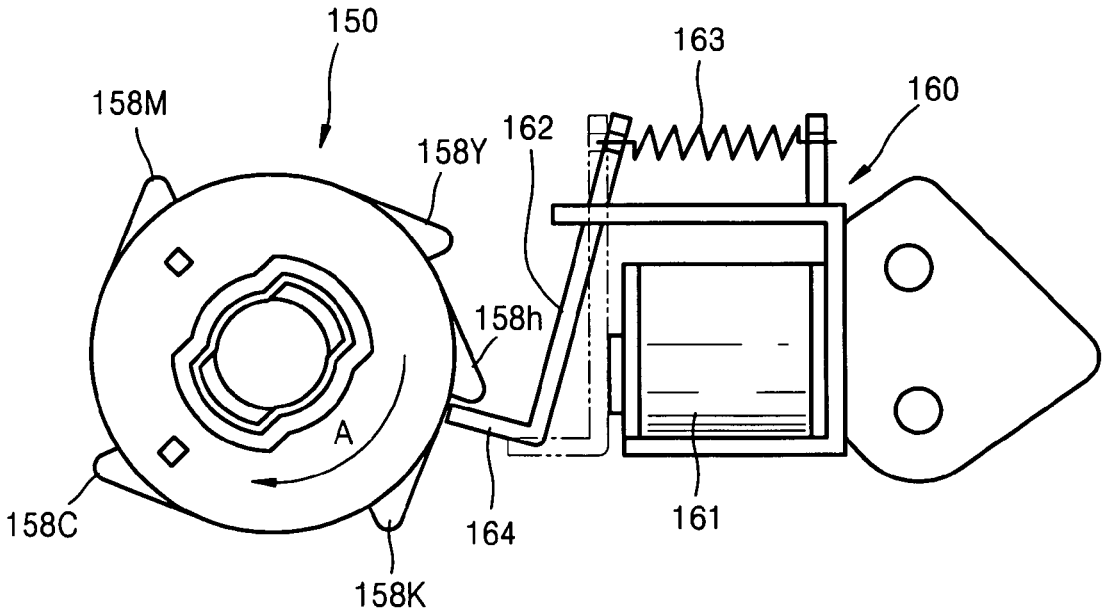
FIG. 7 is a diagram illustrating an operation of the spring clutch and the solenoid of FIG. 6.

Referring to FIG. 7, when current is not supplied to the coil unit 161, the stopper 164 of the moving side 162 moves forward, as illustrated by the solid line, and hooks one of the coupling portions 158, thereby preventing rotation of the clutch hub 157. If the clutch hub 157 does not rotate, the clutch spring 159 is twisted such that its diameter increases because the second end 159*b* of the clutch spring 159 is inserted into the inserting hole 156 of the clutch hub 157. Then, the friction between the clutch spring 159 and the cylindrical portion 153 of the clutch gear 151 decreases, and the clutch spring 159 and the cylindrical portion 153 of the clutch gear 151 slips, thereby fixing the clutch spring 159 and the bushing 152. Therefore, the cam shaft 120 stops rotating. When the current is supplied to the coil unit 161, the moving side 162 adheres to the coil unit 161, as illustrated by the dashed lines in FIG. 7, and the stopper 164 is separated from the coupling portion 158. Then, as described above, the cam shaft 120 rotates when the clutch gear 151 is rotated by the driving motor 110.

Referring back to FIG. 3, a home position indicating element 132 is formed on the cam shaft 120 to check the initial location of the cam shaft 120. A sensor 140 senses the home position indicating element 132. In an exemplary embodiment of the present invention, the sensor 140 is preferably an optical sensor. A home position coupling portion 158h corresponding to the phase of the home position indicating element 132 is formed on the clutch hub 157. When the stopper 164 of the solenoid 160 is coupled to the home position coupling portion 158*h*, the cam shaft 120 stops rotating while located at a home position. In an exemplary embodiment of the present invention, the home position is when a high voltage bias is not supplied to any of the four developing units 4, that is, when all of the four switches 20 are turned "off." Therefore, the phase of the home position indicating element 132 does not overlap with the phases of the four coupling portions 158. Phasewise, the home position indicating element 132 precedes the home position coupling portion 158*h*. When current supplied to the solenoid 160 is blocked after the home position indicating element 132 is sensed by the sensor 140, the moving side 162 moves to the location indicated by the solid line in FIG. 7. When the cam shaft 120 rotates and the home position coupling portion 158*h* is stopped by the stopper 164, the rotational force from the driving motor 110 is blocked and the cam shaft 120 stops at the home position.

According to the structure described above, the four cams 131 may be stopped in the home position. According to an image forming process, an electrostatic latent image of, for example, yellow may be formed on the photosensitive drum 1. When current is supplied to the coil unit 161 of the solenoid 160, the home position coupling portion 158*h* is released from the stopper 164. Then, the rotational force of the driving motor 110 is transmitted to the cam shaft 120, and thus, the cam shaft 120 rotates in the direction A indicated in FIG. 7. When the current supplied to the coil unit 161 is blocked after the stopper 164 releases the home position coupling portion 158*h*, the stopper 164 returns to the location illustrated by the solid line in FIG. 7 due to the elastic force of the spring 163. As the cam shaft 120 rotates, the cam 131Y contacts the contact point 21 by pushing the contact point 22. The switch 20Y is turned "on" and a high voltage bias is supplied to the developing unit 4Y. When the coupling portion 158Y is coupled to the stopper 164, the rotational force transmitted from the driving motor 110 to the cam shaft 120 via the spring clutch 150 is blocked, and thus the cam shaft 120 stops rotating.

After the developing and intermediary transferring of the yellow color is completed, developing of the subsequent color, which may be the magenta color, is started. When current is supplied to the coil unit 161 of the solenoid 160, the stopper 164 releases the coupling portion 158Y. Then, the rotational force of the driving motor 110 is transmitted to the cam shaft 120, thereby rotating the cam shaft 120 in the direction A indicated in FIG. 7. When current supplied to the coil unit 161 is blocked after the stopper 164 releases the coupling portion 158Y, the stopper 164 returns to the location illustrated by the solid line in FIG. 7 due to the elastic force of the spring 163. As the cam shaft 120 rotates, the switch 20Y is turned "off," thereby blocking supplying of a high voltage bias to the developing unit 4Y. The cam 131M contacts the contact point 21M by pushing the contact point 22M. The switch 20M is turned "on," and the high voltage bias is supplied to the developing unit 4M. When the coupling portion 158M is coupled to the stopper 164, the rotational force transmitted from the driving motor 110 to the cam shaft 120 is blocked by the spring clutch 150, and so the cam shaft 120 stops rotating. Only the developing unit 4M operates to develop and transfer the magenta color to the intermediary belt 6.

The above described process for developing and intermediary transferring are repeated for the cyan and black colors. The color toner image transferred on the intermediary belt 6 is finally transferred onto the print paper P. The fixing unit 9 fixes the color toner image transferred onto the print paper P by applying heat and pressure.

According to the above described exemplary embodiments, the cam shaft 120 and the cams 131 may be operated using the driving motor 110, which drives other components of the electrophotographic image forming apparatus by including the regulating element. Therefore, a compact high voltage switch device and image forming apparatus that are moderately priced may be manufactured.

Figure 9:
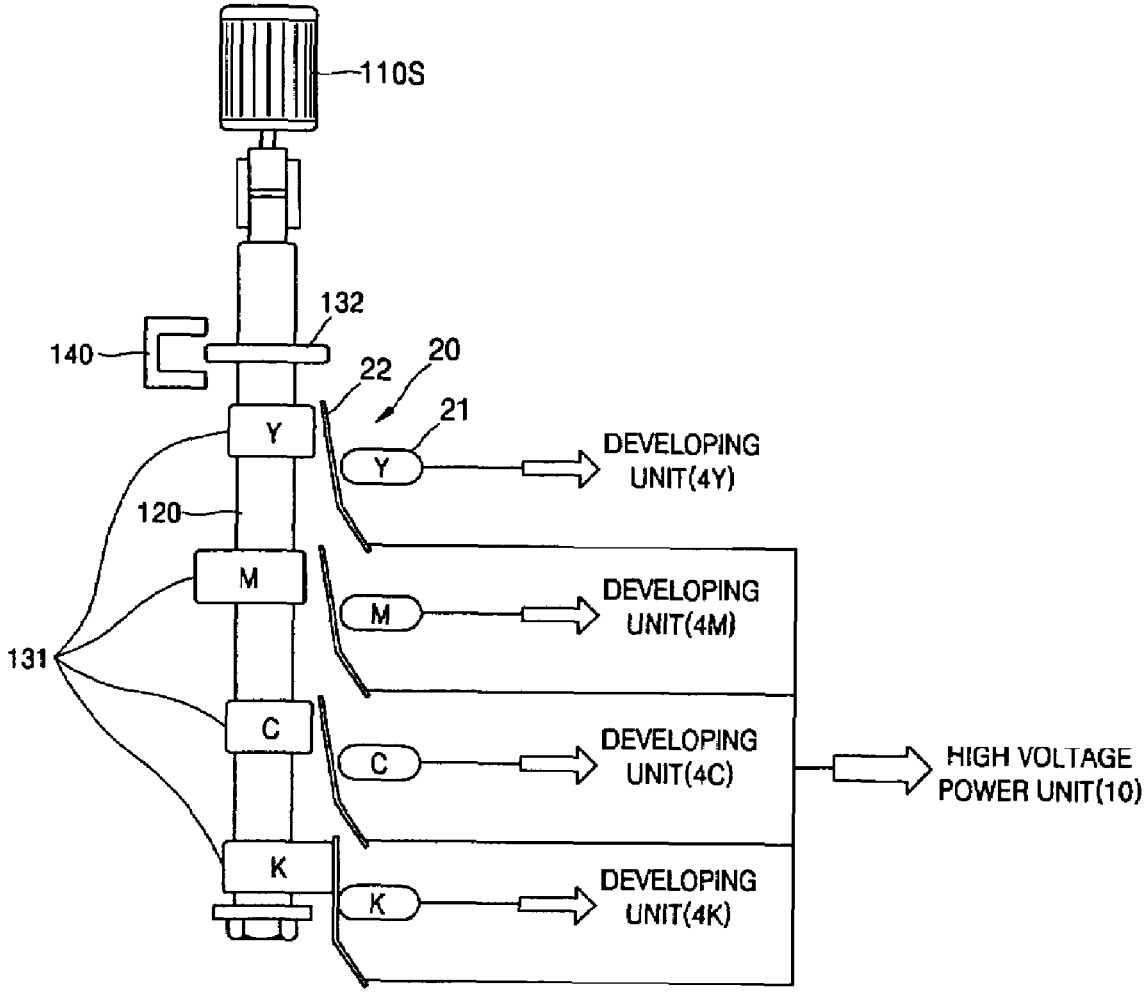
FIG. 9 is a diagram of a high voltage switch device according to another exemplary embodiment of the present invention.

As illustrated in FIG. 9, a separate motor 110S may be used to rotate the cam shaft 120. In this case, the spring clutch 150 and the solenoid 160 are not required. The motor 110S maybe a stepping motor. First, a home position of the cam shaft 120 is checked by sensing the home position indicating element 132 using the sensor 140, and then the motor 110S is rotated a predetermined number of steps, thereby selectively rotating the four developing units 4.

Figure 10:
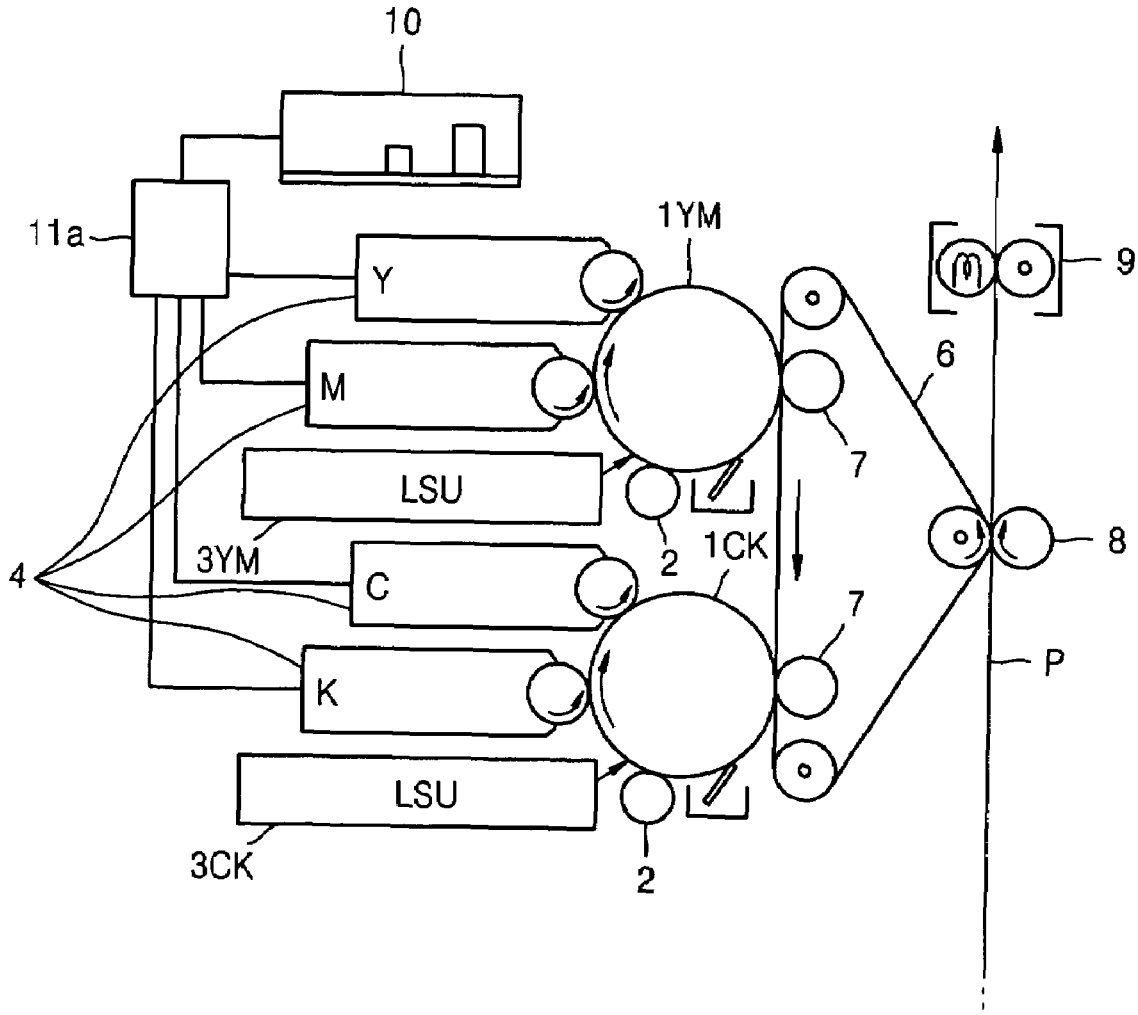
FIG. 10 is a schematic diagram of an electrophotographic image forming apparatus according to another exemplary embodiment of the present invention.

FIG. 10 is a diagram of a modified multi-pass image forming apparatus including two photosensitive drums 1YM and 1CK and two exposure units 3YM and 3CK. Although not illustrated, two photosensitive belts can be used instead of the photosensitive drums 1YM and 1CK. A plurality of developing units 4 are divided into two groups. For example, yellow and magenta developing units 4Y and 4M face the photosensitive drum 1YM, and cyan and black developing units 4C and 4K face the photosensitive drum 1CK. The exposure units 3YM and 3CK respectively emit corresponding image information onto the photosensitive drums 1YM and 1CK.

An image forming process of the by the multi-pass image forming apparatus having the above-described structure will be briefly described. The exposure units 3YM and 3CK respectively emit rays modulated to correspond yellow and cyan image information onto the photosensitive drums 1YM and 1CK, thereby forming electrostatic latent images of yellow and cyan images. Next, the yellow color developing unit 4Y and the cyan color developing unit 4C respectively supply yellow and cyan toners to the photosensitive drums 1YM and 1CK, thereby forming yellow and cyan color toner images. The yellow and cyan color toner images are transferred onto an intermediary transfer belt 6 and overlap with each other.

After the transferring of the yellow and cyan color toner images are completed, the exposure units 3YM and 3CK respectively emit rays modulated to correspond magenta and black image information onto the photosensitive drums 1YM and 1CK, thereby forming electrostatic latent images of magenta and black images. Next, the magenta color developing unit 4M and the black color developing unit 4K respectively supply magenta and black toners to the photosensitive drums 1YM and 1CK, thereby forming magenta and black color toner images. The magenta and black color toner images are transferred onto the intermediary transfer belt 6 and overlap with each other. As a result, a color toner image is produced in which the yellow, cyan, magenta, and black color toner images are overlapped. The color toner image is transferred onto a print paper P passing between the intermediary belt 6 and a second transfer roller 8. A fixing unit 9 fixes the color toner image onto the print paper P through heat and pressure.

By the process described above, a multi-pass color image forming apparatus including two photosensitive drums 1YM and 1CK, two exposure unit 3YM and 3CK, and four developing units 4 may be configured. According to the described structure, the speed of color printing is doubled than that of the image forming apparatus illustrated in FIGS. 1 and 8.

Figure 11:
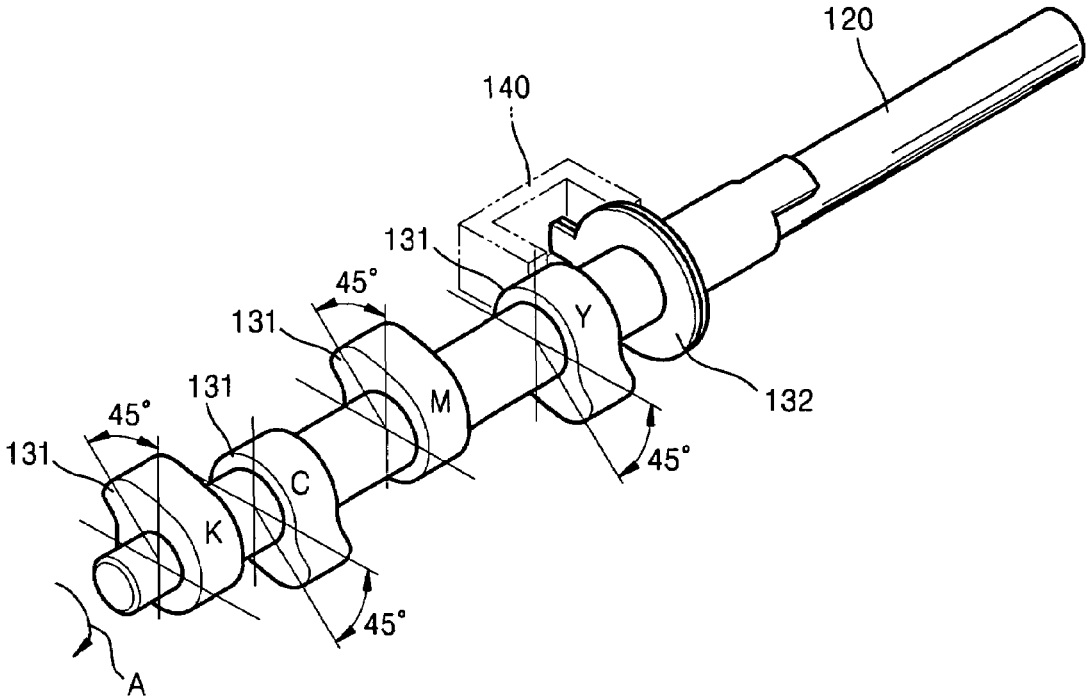
FIG. 11 is a perspective view of a cam and cam shaft for high voltage switching included in the electrophotographic image forming apparatus of FIG.10.
Figure 12:
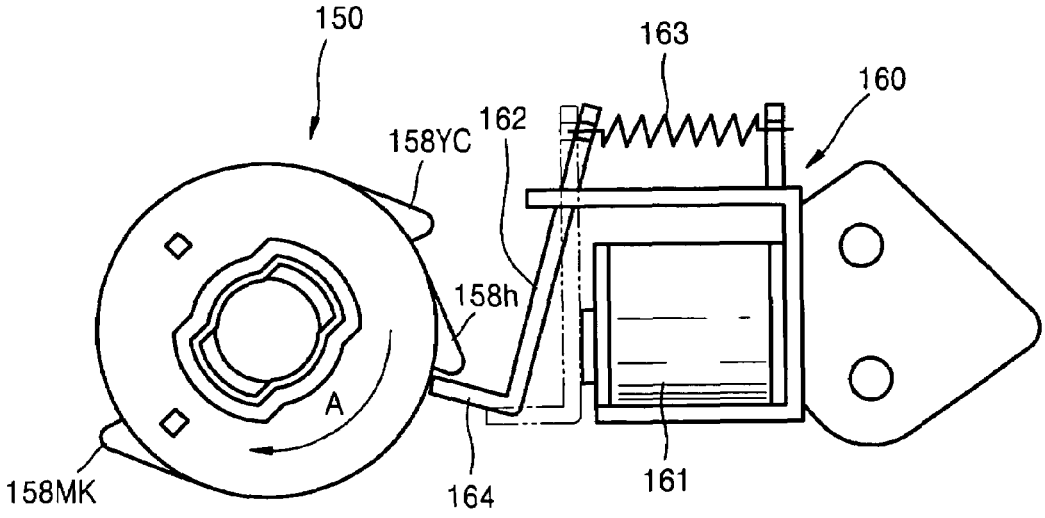
FIG. 12 is a diagram illustrating a spring clutch for high voltage switching included in the electrophotographic image forming apparatus of FIG. 10.

A high voltage switch device 11*a* included in the multi-pass image forming apparatus illustrated in FIG. 10 may be formed by modifying a portion of the high voltage switch device 11 illustrated in FIGS. 1 through 9. As illustrated in FIG. 11, a plurality of cams 131 are divided into two groups. That is, the cams 131Y and 131C form one group and the cams 131M and 131K form the other group. The cams 131Y and 131C included in the same group have the same phases, and the cams 131M and 131K included in the same group have the same phases. Also, as illustrated in FIG. 12, two coupling portions 158YC and 158MK, which respectively correspond to the cams 131Y and 131C and the cams 131M and 131K, are formed on a clutch hub 157. Although not illustrated, the stepping motor 110S illustrated in FIG. 9 may be included instead of a regulating element in the high voltage switch device 11*a*.

According to an exemplary embodiment of the present invention described above, a low-priced, compact and reliable high voltage switch device and a multi-pass image forming apparatus compared to a conventional high voltage switch device including four solenoids and an image forming apparatus may be configured.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A high voltage switch device of an image forming apparatus, comprising:

a plurality of switches installed between a high voltage power unit and a plurality of developing units;

a driving source to drive the plurality of developing units;

a cam shaft rotated by the driving source;

a plurality of cams disposed on the cam shaft corresponding to the respective plurality of switches, and adapted to selectively turn "on" and "off" the switches as the cam shaft rotates; and a regulating element connected between the driving source and the cam shaft for regulating a driving force transmitted from the driving source to the cam shaft.

2. The high voltage switch device of claim 1, wherein the regulating element includes a spring clutch disposed between the driving source and the cam shaft having a plurality of coupling portions corresponding to the phases of the plurality of cams; and an actuator selectively coupled to the coupling portions to selectively operate the spring clutch.

3. The high voltage switch device of claim 2, further comprising a home position indicating element formed on the cam shaft;

a sensor for sensing the home position indicating element; and a home position coupling portion formed on the spring clutch at the same phase as the home position indicating element.

4. The high voltage switch device of claim 3, wherein the phase of the home position coupling portion does not overlap with the phases of the coupling portions.

5. The high voltage switch device of claim 1, wherein the plurality of developing units and the plurality of cams are divided into a plurality of groups, and the cams included in the same group have the same phases.

6. The high voltage switch device of claim 5, further comprising a spring clutch disposed between the driving source and the cam shaft, and including a plurality of coupling portions corresponding to the phases of each of the plurality of the cam groups; and an actuator selectively coupled to the coupling portions to selectively operate the spring clutch.

7. The high voltage switch device of claim 6, further comprising a home position indicating element formed on the cam shaft;

a sensor for sensing the home position indicating element; and a home position coupling portion formed on the spring clutch at the same phase as the home position indicating element.

8. The high voltage switch device of claim 7, wherein the phase of the home position coupling portion does not overlap with the phases of the coupling portions.

9. A multi-pass image forming apparatus that sequentially develops a single-color toner image on a photosensitive medium by sequentially operating a plurality of developing units facing the photosensitive medium and prints a color image by transferring the single-color toner images on top of each other on an intermediary transfer medium, the multi-pass image forming apparatus comprising:

a plurality of switches disposed between a high voltage power unit and the developing units;

a driving source to drive the plurality of developing units;

a cam shaft rotated by the driving source;

a plurality of cams disposed on the cam shaft corresponding to the respective plurality of switches, and selectively operating the plurality of switches as the cam shaft rotates; and a regulating element for regulating a driving force transmitted from the driving source to the cam shaft.

10. The multi-pass image forming apparatus of claim 9, wherein the regulating element includes a spring clutch disposed between the driving source and the cam shaft, and having a plurality of coupling portions corresponding to the phases of the cams; and an actuator selectively coupled to the coupling portions to selectively operate the spring clutch.

11. The multi-pass image forming apparatus of claim 10, further comprising a home position indicating element formed on the cam shaft;

a sensor for sensing the home position indicating element; and a home position coupling portion formed on the spring clutch at the same phase as the home position indicating element.

12. The multi-pass image forming apparatus of claim 11, wherein the phase of the home position coupling portion does not overlap with the phases of the coupling portions.

13. The multi-pass image forming apparatus of claim 9, wherein two photosensitive media are disposed in the multi-pass image forming apparatus; and four developing units accommodating yellow, magenta, cyan, and black color toners are disposed in the multi-pass image forming apparatus, wherein the four developing units are divided into two groups and the developing units of each group respectively face the two photosensitive media, and the cams are divided into two groups each corresponding to the two groups of the developing units and the cams included in the same group have the same phases.

14. The multi-pass image forming apparatus of claim 13, further comprising a spring clutch disposed between the driving source and the cam shaft, and including a plurality of coupling portions corresponding to the phases of the two cam groups; and an actuator selectively coupled to the coupling portions to selectively operate the spring clutch.

15. The multi-pass image forming apparatus of claim 14, wherein a home position indicating element is formed on the cam shaft;

a sensor for sensing the home position indicating element; and a home position coupling portion is formed on the spring clutch at the same phase as the home position indicating element.

16. The multi-pass image forming apparatus of claim 14, wherein the phase of the home position coupling portion does not overlap with the phases of the coupling portions.

17. A multi-pass image forming apparatus, comprising:

a plurality of developing units;

a driving source to drive the plurality of developing units;

a cam shaft rotated by the drive source;

a plurality of cams disposed on the cam shaft corresponding to the respective plurality of developing units and electrically interacting with the respective plurality of developing units to selectively transmit a high voltage power from a high voltage power unit to the respective plurality of developing units; and a regulating element for regulating a driving force transmitted from the driving source to the cam shaft.

18. The multi-pass image forming apparatus of claim 17, wherein the plurality of developing units are fixedly positioned.

19. The multi-pass image forming apparatus of claim 17, wherein a plurality of switches are disposed between a high voltage power unit and a plurality of developing units, the plurality of cams electrically interacting with the respective plurality of developing units through the plurality of switches to selectively transmit the high voltage power from the high voltage power unit to the respective plurality of developing units.

* * * * *